US010717637B2

(12) United States Patent
Pellaud et al.

(10) Patent No.: US 10,717,637 B2
(45) Date of Patent: Jul. 21, 2020

(54) BEVERAGE DISPENSING DEVICE WITH MIXING CHAMBER AND COOLING FUNCTIONALITY

(71) Applicant: Anheuser-Busch InBev S.A., Brussels (BE)

(72) Inventors: Jerome Pellaud, New Rochelle, NY (US); Daniel Peirsman, Leuven (BE)

(73) Assignee: Anheuser-Busch InBev S.A., Brussels (BE)

( * ) Notice: Subject to any disclaimer, the term of this patent is extended or adjusted under 35 U.S.C. 154(b) by 0 days.

(21) Appl. No.: 15/514,479

(22) PCT Filed: Sep. 25, 2015

(86) PCT No.: PCT/EP2015/072122
§ 371 (c)(1),
(2) Date: Mar. 24, 2017

(87) PCT Pub. No.: WO2016/046373
PCT Pub. Date: Mar. 31, 2016

(65) Prior Publication Data

US 2017/0240411 A1 Aug. 24, 2017

(30) Foreign Application Priority Data

Sep. 26, 2014 (EP) ..... 14186706

(51) Int. Cl.
*B67D 1/00* (2006.01)
*B67D 1/08* (2006.01)

(52) U.S. Cl.
CPC ..... *B67D 1/0884* (2013.01); *B67D 1/0021* (2013.01); *B67D 1/0051* (2013.01);
(Continued)

(58) Field of Classification Search
CPC .. B67D 1/0884; B67D 1/0016; B67D 1/0021; B67D 1/0051; B67D 1/0078;
(Continued)

(56) References Cited

U.S. PATENT DOCUMENTS 5,292,030 A * 3/1994 Kateman ..... A23G 9/04 222/1
5,758,571 A 6/1998 Kateman et al.
(Continued)

FOREIGN PATENT DOCUMENTS

| | | |
|---|---|---|
| EP | 0 771 758 | 5/1997 |
| EP | 0 947 518 | 10/1999 |
| WO | WO 97/12184 | 4/1997 |

*Primary Examiner* — Frederick C Nicolas
(74) *Attorney, Agent, or Firm* — Levy & Grandinetti

(57) ABSTRACT

A beverage dispensing device prepares and dispenses a beverage. The dispensing device includes a housing which has a beverage unit with a liquid inlet and a beverage outlet. The beverage unit has a receiver for at least one container containing a unit dose of concentrated beverage ingredient to be dispensed, and an ingredient discharge. The beverage unit has a liquid line. The liquid line first section extends from the base liquid inlet to a receiver liquid inlet to guide base liquid into the unit dose of beverage ingredient through the beverage discharge into the liquid line second section that extends from the ingredient discharge to the beverage outlet. A mixing chamber is defined in the liquid line. Temperature regulator is provided in the mixing chamber or the mixing chamber comprises an inlet for pressurized fluid for expanding the fluid in the mixing chamber.

4 Claims, 3 Drawing Sheets

(52) U.S. Cl.
CPC ..... *B67D 1/0078* (2013.01); *B67D 1/0857* (2013.01); *B67D 1/0888* (2013.01); *B67D 1/0016* (2013.01); *B67D 2001/0092* (2013.01); *B67D 2210/00099* (2013.01); *B67D 2210/00104* (2013.01)

(58) Field of Classification Search
CPC ..... B67D 1/0857; B67D 1/0888; B67D 2001/0092; B67D 2210/00099; B67D 2210/00104
See application file for complete search history.

(56) References Cited

U.S. PATENT DOCUMENTS

| | | | | |
|---|---|---|---|---|
| 6,435,379 | B2 * | 8/2002 | Tansley | B67D 1/0009 141/67 |
| 6,505,758 | B2 * | 1/2003 | Black | B67D 1/0034 222/146.6 |
| 6,923,006 | B2 * | 8/2005 | Walton | B67D 1/0009 222/146.6 |
| 7,975,879 | B2 * | 7/2011 | Groesbeck | B65D 5/4204 220/4.01 |
| 8,459,503 | B2 * | 6/2013 | Groesbeck | B65D 5/4204 220/592.01 |
| 8,985,395 | B2 * | 3/2015 | Tansey | A47J 31/44 222/102 |
| 2014/0154368 | A1 | 6/2014 | Kolls et al. | |
| 2017/0240401 | A1 * | 8/2017 | Pellaud | B67D 1/0016 |
| 2017/0240402 | A1 * | 8/2017 | Pellaud | B67D 1/0021 |

* cited by examiner

BEVERAGE DISPENSING DEVICE WITH MIXING CHAMBER AND COOLING FUNCTIONALITY

The present invention relates to a beverage dispensing device for dispensing different types of beverages or beverage components, wherein at least one of the beverage ingredients is provided in a unit dose as a pod or capsule.

More in particular, the present invention relates to such a beverage dispensing device, wherein at least one of said beverages or beverage components is a malt based beverage or a malt based beverage component.

At present there is a trend to fancier kinds of beverages, wherein multiple beverage components or beverages are added to one another so to provide a consumer with a sensation adapted to his taste.

A goal of this invention is to provide a beverage dispensing device allowing consumers to prepare and serve such fancier beverages at home with one device with a small countertop footprint.

According to the state of the art all kinds of beverage dispensing devices exist which allow for the dispensing of different types of beverages or beverage components, such as beverage dispensing devices for dispensing different types of coffees and teas possibly mixed with milk, cream or sugar and so on.

Usually, the coffee or tea is made by passing hot water through coffee powder or tea leaves respectively.

Other beverage dispensing devices are for example intended for dispensing all kinds of juices or sodas.

It is clear that such beverage dispensing devices are of a complete other category than the type of beverage dispensing devices of interest in the present invention.

Indeed, the dispensing of different types of beverages or beverage components wherein at least one of the one of said beverages or beverage components is a malt based beverage or a malt based beverage component requires adapted equipment which is capable of coping with the specific needs related to malt based beverages or beverage components.

For example when dispensing a malt based beverage or beverage component, it is important to control foaming of the concerned beverage or beverage component.

Also, in beverage dispensing device having supply lines through which malt based beverages or malt based beverages are passed, a biofilm is slowly formed into the supply lines.

This biofilm reduces the quality for as far as the taste and smell is concerned of the dispensed malt based beverages or beverage components through the supply lines and must therefore be very regularly removed by a thorough cleaning of the supply lines.

Furthermore, the rate of dispensing, the pressures involved during dispensing and the volumes of liquid dispensed in beverage dispensing devices wherein at least one of the beverages or beverage components is a malt based beverage or a malt based beverage component are usually much higher than in the typical coffee machines or the like and require adapted equipment with increased capacity and strength.

Apart from the above differences it is to be understood that some ingredients are easy to concentrate and can be concentrated with a high concentration factor without impact on the quality, other ingredients however are far more difficult to concentrate without use of quality.

As a result, some ingredients can be loaded in a pod in very low levels (highly concentrated), whilst others can be loaded in a pod in only slightly concentrated form, resulting in a relative large volume.

The volume ratio between cooled base liquid and ingredients originating from the pods or capsules is a critical factor for the temperature at which the final beverage can be dispensed, and unlike coffee or tea which are dispensed hot or unlike soft drinks having a high sugar content, a base liquid of a malt based beverage has a freezing temperature of approximately 0° C., while the ideal dispensing temperature is between 2 and 5° C. Hence the temperature with which the base liquid may warm during the mixing and dispensing of the beverage is very small and to amount of concentrated ingredient added to the base liquid should be as small as possible not to jeopardize dispensing a final beverage at a desired temperature.

It is therefore an objective of this invention to overcome one or more of the above-mentioned drawbacks or possibly other non-mentioned drawbacks of the known beverage dispensing devices.

The present invention addresses the above and other drawbacks and concerns a beverage dispensing device for preparing and dispensing a beverage comprising a housing comprising a beverage unit with a liquid inlet and a beverage outlet, the beverage unit comprising:

- receiving means for receiving at least one cartridge or pod containing a unit dose of concentrated ingredient of the beverage to be dispensed and comprising a ingredient discharge, and
- a liquid line in connected to the liquid inlet, with the ingredient discharge and with the beverage outlet;
- a mixing chamber defined in the liquid line; characterized in that temperature regulating means are provided in the mixing chamber or in that the mixing chamber comprises an inlet for pressurized fluid for expanding said fluid in said mixing chamber.

Said temperature regulating means preferably comprise cooling fins extending in the mixing chamber, said cooling fins connected to a heat exchanger for removing heat from the fins out of the mixing chamber.

According to an alternative embodiment the dispensing device comprises;

- a temperature sensor configured to measure the temperature in the mixing chamber in real-time;
- microprocessor and actuator assembly controlling the heat exchanger based on an input of the temperature sensor.
- a valve provided at a beverage outlet of the mixing chamber, the valve being controlled by an actuator electronically coupled to the microprocessor.

According to a preferred embodiment said pressurized fluid inlet is connected or connectable to a source of pressurized fluid at a pressure of at least 0.5 bar higher, preferably at least 2 bar higher than the pressure reigning in the mixing chamber during mixing of an ingredient with a base liquid.

In this case the pressurized fluid inlet preferably comprises a valve allowing controlled opening and closing of the inlet.

The beverage dispensing may further comprise:

- a temperature sensor configured to measure the temperature in the mixing chamber in real-time;
- microprocessor and actuator assembly controlling the valve of the pressurized fluid inlet based on an input provided by the temperature sensor.

a valve provided at a beverage outlet of the mixing chamber, the valve being controlled by an actuator electronically coupled to the microprocessor.

The present invention also concerns an ingredient container comprising at least two chambers separated by a wall, wherein a first ingredient chamber contains a unit dose of concentrated ingredient and comprises a liquid inlet sealed by a frangible lid or valve and an ingredient discharge fluidly closed by a valve and connecting the ingredient chamber with the second mixing chamber; the mixing chamber comprising a beverage outlet closed by a valve and contains an amount of pressurized gas at a pressure higher than the pressure reigning in the mixing chamber when the liquid inlet and the ingredient discharge are closed.

The valve closing the ingredient discharge is preferably configured to open prior to opening the valve of the beverage outlet, thereby allowing expansion of the pressurized gas in the ingredient container. This valve at the beverage outlet preferably is a one way valve allowing a fluid stream from the mixing chamber through the beverage outlet and may be actuated by a spring biasing the valve to an open position against the pressure inside the mixing chamber such that the valve opens upon a pressure drop inside the mixing chamber upon expansion of the pressurized gas therein.

With the intention of better showing the characteristics of the invention, hereafter, as example without any limitative character, some embodiments of a beverage dispensing device according to the invention are described, with reference to the accompanying drawings, wherein:

DETAILED DESCRIPTION

Figure 1:
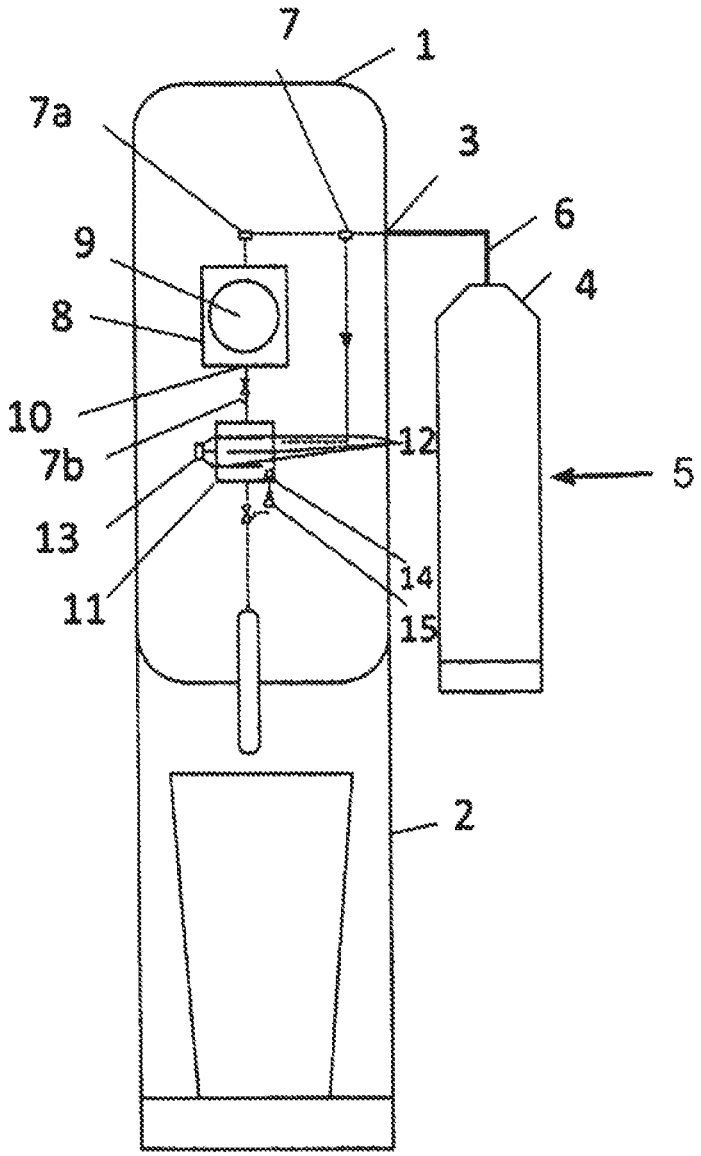
FIG. 1 is a schematic illustration of a first embodiment of a beverage dispensing device in accordance with the present invention.
Figure 2:
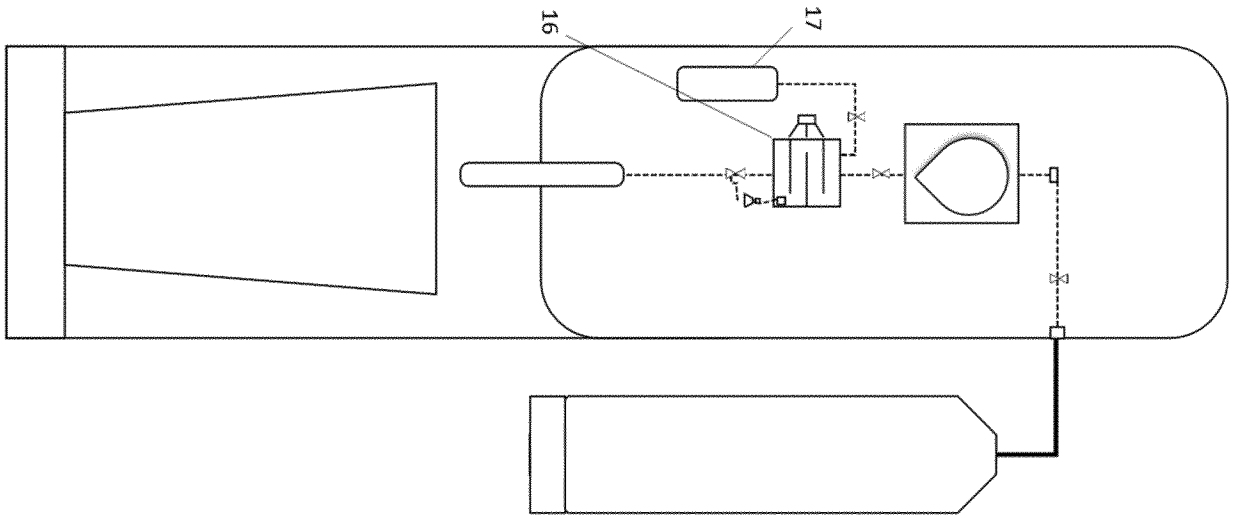
FIG. 2 schematically represents an alternative embodiment of the beverage dispensing device according to the invention.
Figure 3:
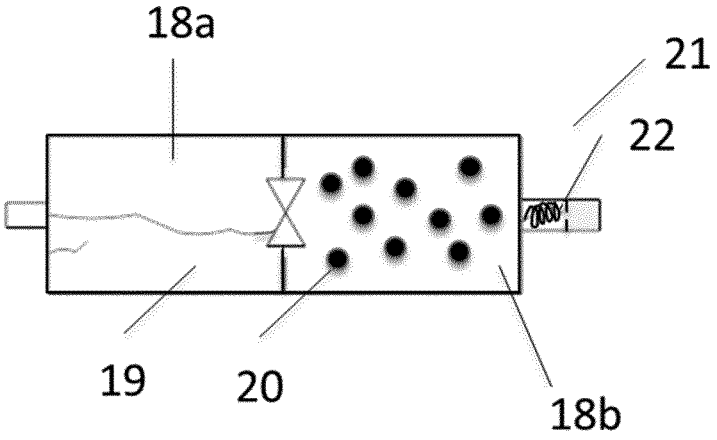
FIG. 3 schematically represents an ingredient container according to the present invention.

The a beverage dispenser 1 according to the invention, illustrated in FIGS. 1 and 2, is a beverage dispenser 1 of the type addressed as a home appliance, which is typically designed for home use to dispense one beverage per dispense cycle and which is configured as a table top appliance meaning it has a restricted height of about maximum 50 cm and a areal footprint of about maximum 2500 $cm^2$.

The beverage dispenser comprises a housing 2 comprising a base liquid inlet 3 which is connected to a source 4 of a first base liquid source 5.

The dispenser beverage inlet 3 can for example be a pipe fitting which is suitable for connecting a source 4 to the beverage dispenser 1 or it can just be the inlet of a pipe or flexible tube used for flow of the base liquid 5 away from the source 4.

The base liquid 5 can be any product that could be used for composing a beverage, such as for example water, a malt-based beverage, a fermented beverage, beer, a cider based beverage or cider, a juice, a soft drink, milk, cream, coffee, tea or mixtures thereof, the base liquid source can either be non-carbonated or carbonated.

Depending on the type of the base liquid 5, the source 4 from which the beverage component 5 is supplied and in which the beverage component 5 is contained, can be for example a container, a plastic bag, a bottle, a keg or cask and so on.

The source 4 can be a pressurized vessel, containing a pressurized gas for driving the base liquid 5 out of the vessel.

In other cases the source 4 can comprise pumping means or separate gas bottles for that purpose, or the base liquid 5 can for example just leave the source 4 under the influence of gravity.

It is clear that all kinds of other commonly used elements, such as valves, switches, detectors, electronic or not electronic controller equipment in general are not represented in the drawings.

The source 4 is in this case connected to the inlet 3 by means of a liquid line 6, formed for example by a flexible or rigid tube or pipe 6.

Turning now to the housing of the dispensing device, the base liquid inlet is coupled to a liquid line 7 extending from the base liquid inlet to a beverage outlet through which a final beverage is to be dispensed.

The housing further comprises at least one container receiving means 8 for receiving an ingredient container 9 such as a pod or capsule comprising a unit dose of a beverage ingredient. The receiving means comprising an ingredient discharge through which the unit dose contained in the pod or capsule can be discharged in the fluid line upon dispensing.

The ingredient containers comprise exactly one unit dose of beverage ingredient and are therefore suited for preparing exactly one beverage allowing maximal flexibility to customize a beverage to be dispensed. The ingredient containers are preferably of the kind generally addressed as pods or capsules and will be referred to as such in the description below.

The pods or capsules preferably comprise a solid or liquid ingredient, varying from hop concentrates, fruit concentrates, sweeteners, bittering additives, concentrated spices, foaming promoters, concentrated malt-based liquids, concentrated fermented liquids, concentrated beer, colorants and or mixtures thereof.

In this case the liquid line comprises two sections 7*a*, 7*b*, a first extending from the base liquid inlet to a liquid inlet of the receiving means for guiding base liquid into the pod or capsule such as to discharge the unit dose beverage ingredient through the beverage discharge 10 into the second section of the liquid line extending from the ingredient discharge at the receiving means to the beverage outlet.

At a location downstream the ingredient discharge, a mixing chamber 11 is provided in the liquid line, which mixing chamber comprises a wall defining a chamber having a liquid inlet and a liquid outlet, both controlled by a valve.

According to the embodiment represented in FIG. 1, cooling means are provided in the mixing chamber in the form of cooling fins 12 made of a heat conductive material.

The cooling fins preferably protruded in the mixing chamber in a pattern such as to prevent the liquid stream comprising the base liquid and the beverage ingredient to flow directly from the mixing chamber liquid inlet to the mixing chamber liquid outlet, and hence allowing creating turbulences in the liquid stream when in the mixing chamber, thereby promoting mixing of the unit dose beverage ingredient with the base liquid.

The cooling fins are coupled to a heat exchanger 13 provided outside the mixing chamber to discharge heat from the mixing chamber to the environment, whereby the heat exchanger can comprise a peltier element (the cooling fins coupled to the cold side of the peltier element) or a heat exchanger based on compression and expansion of a gas to provide cooling. In both cases the heat exchanger is electrically driven.

As represented in FIG. 1 it is preferred that a temperature sensor 14 is provided in the mixing chamber, which sensor is configured to measure the temperature in the mixing chamber in real-time during dispensing; and that a microprocessor and actuator assembly 15 are provided in the housing of the dispensing device controlling the heat exchanger based on an input of the temperature sensor.

The microprocessor preferably also controls the valve at the liquid outlet of the mixing chamber based on the input of the temperature sensor such that the mixing chamber outlet is opened only when the beverage mixture therein has a temperature within a desired range for dispensing the beverage.

In the embodiment according to FIG. 2, mixing chamber comprises a pressurized fluid inlet 16 coupled to a source of pressurized fluid 17 such as $CO_2$, $N_2$ or $N_2O$ through a pressure valve, whereby the fluid stored in the source of pressurized gas is maintained at a pressure of at least 0.5 bar higher, preferably at least 2 bar higher than the pressure reigning in the mixing chamber during mixing when the valve at the outlet of the mixing chamber is open and the mixing chamber is in fluid communication with the ambient. The pressure reigning the mixing chamber in that case being comprised between 0.1 and 1 bar overpressure in view of the ambient.

Clearly the pressure in the source of pressurized fluid much higher, increasing the expansion of the fluid when entering the mixing chamber and thereby increasing the cooling capacity in the mixing chamber.

The expansion of a small volume of pressurized gas in the mixing chamber will have a cooling effect on the beverage in the mixing chamber allowing compensating any excessive heat of the beverage due to mixing of the cooled base liquid with the more warm beverage ingredient.

The source of pressurized gas can either be a metal high pressure cartridge comprising liquid food grade $CO_2$, $N_2$ or $N_2O$ readily available on the market or can be a plastic cartridge comprising food grade $CO_2$, $N_2$ or $N_2O$ at lower pressures of between 4 and 2 bar.

According to another alternative embodiment, the mixing chamber is unitary with the pod or capsule. In this case the pod or capsule comprises at least two chambers 18*a*, 18*b* separated by a wall, wherein a first ingredient chamber contains a unit dose of concentrated ingredient 19 and comprises a liquid inlet sealed by a frangible lid or valve and an ingredient discharge fluidly closed by a valve and connecting the ingredient chamber with the second mixing chamber; the mixing chamber comprising a beverage outlet closed by a valve and contains an amount of pressurized gas 20 at a pressure higher than the pressure reigning in the mixing chamber when the liquid inlet and the ingredient discharge are closed.

The valve 21 closing the ingredient discharge is hereby configured to open prior to opening the valve of the beverage outlet, thereby allowing expansion of the pressurized gas in the ingredient container.

This can be achieved by making the valve actuated by a spring 22 biasing the valve to an open position against the pressure inside the mixing chamber which exceeds the pressure outside the mixing chamber such that the valve opens upon a pressure drop inside the mixing chamber which pressure drop is a result of the expansion of the pressurized gas in the container when the ingredient discharge valve is opened.

The pressurized gas in the closed mixing chamber is preferably maintained at a pressure ranging between 2 and 4 bar.

The invention claimed is:

1. A beverage dispensing device for preparing and dispensing a beverage comprising a housing comprising a beverage unit with a liquid inlet and a beverage outlet, the beverage unit comprising:

receiving means for receiving at least one container containing a unit dose of concentrated ingredient of the beverage to be dispensed and comprising an ingredient discharge, and a liquid line connected to the liquid inlet, with the ingredient discharge and with the beverage outlet;

a mixing chamber defined in the liquid line;

wherein the mixing chamber further comprises a pressurized fluid inlet coupled to a source of pressurized fluid through a pressure valve, for expanding said pressurized fluid in said mixing chamber, wherein said pressurized fluid is maintained in said source of pressurized fluid at a pressure of at least 0.5 bar higher than a pressure reigning in the mixing chamber during mixing of the ingredient with a base liquid.

2. A beverage dispensing device according to claim 1, wherein said pressurized fluid is maintained in said source of pressurized fluid at a pressure of at least 2 bar higher than the pressure reigning in the mixing chamber during mixing of the ingredient with the base liquid.

3. The beverage dispensing device according to claim 1, comprising:

a temperature sensor configured to measure a temperature in the mixing chamber in real-time;

a microprocessor and actuator assembly controlling the valve of the pressurized fluid inlet based on an input provided by the temperature sensor.

4. The beverage dispensing device according to claim 3, having a valve provided at a beverage outlet of the mixing chamber, the valve being controlled by an actuator electronically coupled to the microprocessor.

* * * * *